US007102610B2

(12) United States Patent
Ludden

(10) Patent No.: US 7,102,610 B2
(45) Date of Patent: Sep. 5, 2006

(54) DISPLAY SYSTEM WITH FRAME BUFFER AND POWER SAVING SEQUENCE

(75) Inventor: Christopher A. Ludden, Pittsford, NY (US)

(73) Assignee: National Semiconductor Corporation, Santa Clara, CA (US)

( * ) Notice: Subject to any disclaimer, the term of this patent is extended or adjusted under 35 U.S.C. 154(b) by 131 days.

(21) Appl. No.: 10/421,646

(22) Filed: Apr. 21, 2003

(65) Prior Publication Data

US 2004/0207592 A1 Oct. 21, 2004

(51) Int. Cl.
*G09G 3/36* (2006.01)

(52) U.S. Cl. ..... 345/98; 345/100; 345/96

(58) Field of Classification Search ..... 345/94, 345/95–96, 208–211, 87, 90, 98–100, 204, 345/3.2, 54, 79
See application file for complete search history.

(56) References Cited

U.S. PATENT DOCUMENTS 5,220,314 A * 6/1993 Mano et al. ..... 345/88
5,648,792 A * 7/1997 Sato et al. ..... 345/92
5,818,413 A * 10/1998 Hayashi et al. ..... 345/100
6,140,985 A * 10/2000 Kanai et al. ..... 345/74.1
6,429,842 B1 * 8/2002 Shin et al. ..... 345/92
6,559,822 B1 * 5/2003 Okuzono ..... 345/96
6,618,032 B1 * 9/2003 Seino ..... 345/89
6,717,563 B1 * 4/2004 Kim ..... 345/96
6,943,766 B1 * 9/2005 Nakamura et al. ..... 345/98
2003/0025665 A1 * 2/2003 Janssen et al. ..... 345/98

* cited by examiner

*Primary Examiner*—Xiao Wu
(74) *Attorney, Agent, or Firm*—Darby & Darby, P.C.; Matthew M. Gaffney

(57) ABSTRACT

A method is arranged to process a frame for an LCD with a modified polarity pattern. The pattern employs a polarity reversal scheme that results in line inversion and/or dot inversion patterns that are observable by pixel locations within the frame. The drive polarity for the column drivers in the LCD is toggled according to the modified polarity pattern. The scanning sequence for each row on the display is modified for cooperation with the pattern. A first subframe is scanned during a first interval while applying a first set of drive polarities. A second subframe is scanned during a second interval that is non-overlapping with the first time interval. The application of the method enables the column drivers in the LCD to operate with reduced power while retaining the benefits of line and dot inversion techniques.

13 Claims, 11 Drawing Sheets

FRAME N

| LINES \ COLUMNS | 1 | 2 | 3 | 4 |
|---|---|---|---|---|
| 1 | + | + | + | + |
| 2 | + | + | + | + |
| 3 | + | + | + | + |
| 4 | + | + | + | + |

FRAME N+1

| LINES \ COLUMNS | 1 | 2 | 3 | 4 |
|---|---|---|---|---|
| 1 | − | − | − | − |
| 2 | − | − | − | − |
| 3 | − | − | − | − |
| 4 | − | − | − | − |

Figure 1
FRAME INVERSION
(PRIOR ART)

FRAME N+1

COLUMNS

| LINES | 1 | 2 | 3 | 4 |
|---|---|---|---|---|
| 1 | − | − | − | − |
| 2 | + | + | + | + |
| 3 | − | − | − | − |
| 4 | + | + | + | + |

FRAME N

COLUMNS

| LINES | 1 | 2 | 3 | 4 |
|---|---|---|---|---|
| 1 | + | + | + | + |
| 2 | − | − | − | − |
| 3 | + | + | + | + |
| 4 | − | − | − | − |

Figure 2

LINE INVERSION
(PRIOR ART)

FRAME N+1

COLUMNS

| LINES | 1 | 2 | 3 | 4 |
|---|---|---|---|---|
| 1 | − | + | − | + |
| 2 | − | + | − | + |
| 3 | − | + | − | + |
| 4 | − | + | − | + |

FRAME N

COLUMNS

| LINES | 1 | 2 | 3 | 4 |
|---|---|---|---|---|
| 1 | + | − | + | − |
| 2 | + | − | + | − |
| 3 | + | − | + | − |
| 4 | + | − | + | − |

Figure 3

COLUMN INVERSION (PRIOR ART)

FRAME N+1

COLUMNS

| LINES | 1 | 2 | 3 | 4 |
|---|---|---|---|---|
| 1 | − | + | − | + |
| 2 | + | − | + | − |
| 3 | − | + | − | + |
| 4 | + | − | + | − |

FRAME N

COLUMNS

| LINES | 1 | 2 | 3 | 4 |
|---|---|---|---|---|
| 1 | + | − | + | − |
| 2 | − | + | − | + |
| 3 | + | − | + | − |
| 4 | − | + | − | + |

Figure 4

DOT INVERSION (PRIOR ART)

DISPLAY SYSTEM WITH FRAME BUFFER AND POWER SAVING SEQUENCE

FIELD OF THE INVENTION

The present invention relates to the field of LCDs (liquid crystal displays), and, more specifically, to a method of scanning an LCD with reduced power dissipation.

BACKGROUND OF THE INVENTION

Liquid crystal displays (LCDs) are degraded when subject to a long-term DC potential. A long-term DC potential across pixel electrodes creates an electric field that causes electroplating of ion impurities in the liquid crystal onto the electrodes. Electroplating of the ion impurities creates a residual field on the pixel electrodes that causes image retention on the display.

Drive voltages on an LCD typically have a DC component of approximately zero in order to minimize degradation of the LCD. A pixel is typically driven with alternating drive voltages that provide the RMS voltage value to display an image while maintaining an approximately zero average voltage on the pixel. A pixel will have approximately the same brightness when it is driven at the same magnitude at the opposite polarity.

The four polarity schemes that are typically used to drive a display are frame inversion, line inversion, column inversion, and dot inversion. The pixels in a display are addressed sequentially by rows, beginning with row 1. All of the pixels in a row have a common plate and gate lines.

FIG. 1 illustrates an example of frame inversion. Every pixel in a frame is charged with the same polarity when frame inversion is used. Each pixel is driven with the opposite polarity on the subsequent frame. The polarity is reversed after every change in frame to ensure an average DC potential of zero.

FIG. 2 illustrates an example of line inversion. Adjacent lines on the panel are charged with opposite polarities when line inversion is used. The polarity is reversed before each new frame is scanned to ensure an average DC potential of zero.

FIG. 3 illustrates an example of column inversion. Pixels in adjacent columns are charged with opposite polarities when column inversion is used. The polarities of the pixels in each column in a frame are the same. However, the polarity of each column is reversed in each frame. For example, in Frame N as shown in FIG. 3, columns 1 and 3 are charged with a positive polarity, and columns 2 and 4 are charged with a negative polarity. In the next frame, Frame N+1, columns 1 and 3 are charged with a negative polarity, and columns 2 and 4 are charged with a positive polarity.

FIG. 4 illustrates an example of dot inversion. Adjacent pixels in both the horizontal and vertical directions have opposite polarities when dot inversion is used. The polarity of each pixel is reversed before each new frame is scanned to ensure an average DC potential of zero.

Frame inversion and line inversion can be accomplished with a driving technique known as Common Plate Voltage (Vcom) modulation. Drivers with a low-voltage output range (typically 5V) may be used when Vcom modulation is implemented.

There are three artifacts that can occur on LCDs that can be affected by the polarity scheme: flicker, horizontal cross-talk, and vertical cross-talk. Frame inversion is subject to flicker, horizontal cross-talk, and vertical cross-talk. Line inversion reduces flicker and vertical cross-talk while column inversion reduces flicker and horizontal cross-talk. Dot inversion reduces flicker, horizontal cross-talk, and vertical cross-talk, and results in the highest quality image.

The power dissipation associated with driving an LCD is affected by the polarity inversion scheme being used. The power required to drive the display is proportional to the frequency of polarity reversal of the column line voltages. Frame and column inversion have a polarity reversal frequency equal to the frame rate, while line and dot inversion have a polarity reversal with every line in every frame. Thus, if the LCD has 240 rows, line inversion consumes approximately 240 times as much power as frame inversion.

BRIEF DESCRIPTION OF THE DRAWINGS

FIG. 1 illustrates frame inversion according to the prior art.

FIG. 2 illustrates line inversion according to the prior art.

FIG. 3 illustrates column inversion according to the prior art.

FIG. 4 illustrates dot inversion according to the prior art.

DETAILED DESCRIPTION OF THE PREFERRED EMBODIMENT

Figure 5A:
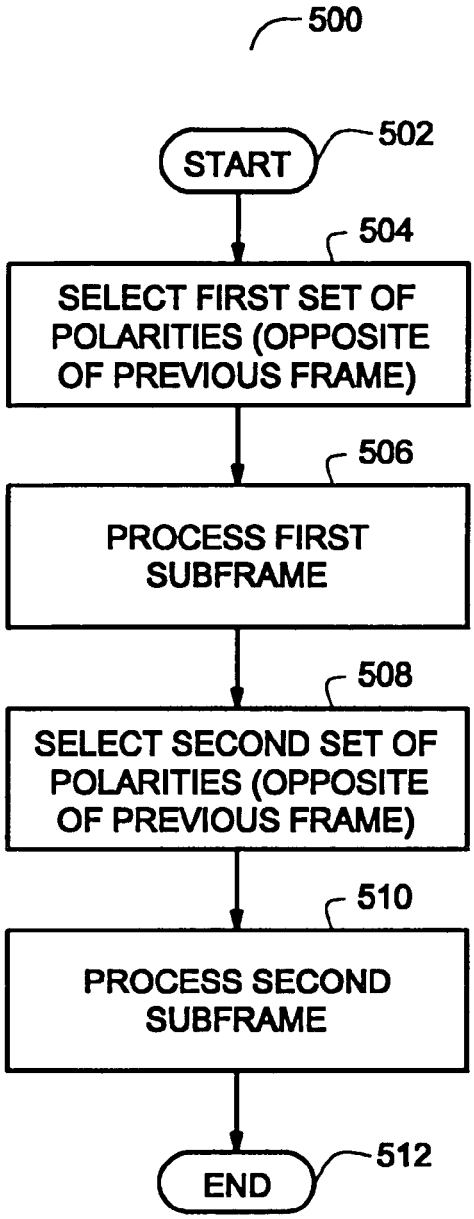
FIG. 5A is a flow chart that illustrates an example process for an LCD.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, or data signal. Referring to the drawings, like numbers indicate like parts throughout the views.

The invention is related to a novel display scan sequence with reduced power dissipation. The invention is further related to a novel scan sequence and modified polarity reversal scheme that achieves a display with line inversion or dot inversion polarity patterns observable at the pixel locations. A display with line inversion or dot inversion polarities patterns observable at the pixels patterns is achieved while toggling the drive polarity of the column voltages at a rate significantly slower than once per line. The invention is further related changing the sequence of scanning the rows such that all of the rows with a first polarity are scanned first, and the rows with the opposite polarity are scanned subsequently.

The invention is further related to obtaining the power consumption advantages of frame or column inversion while obtaining the image quality advantages of line or dot inversion. According to one example, the invention is related to providing reduced power dissipation relative to a conventionally scanned display, which can be an important feature in portable products such as cell-phone handsets, PDAs, and Palm PCs, since the display AC power can be a significant percentage of the system power. According to one example, the invention is related to eliminating the need for partially scanned displays during system standby modes for handset applications.

FIG. 5A illustrates an example process (500) for an LCD, according to aspects of the invention. Processing begins at start block 502.

After start block 502, processing proceeds to block 504. At block 504, a first set of polarities for the column drivers is selected. For example, if a line inversion pattern resulting at the pixel locations is desired, each column may be selected at the same polarity, either positive or negative. Alternatively, if a dot inversion pattern resulting at the pixel locations is desired, each of the adjacent columns may be selected to have an alternating polarity. The first set of polarities for the column drivers is selected such that an associated voltage of each pixel corresponds to approximately zero over time. Processing then proceeds from block 504 to block 506.

At block 506, a first subframe is processed. For example, the first subframe may include the set of all even lines in the frame. Processing proceeds from block 506 to block 508. At block 508, a second set of polarities for the column drivers is selected. For example, the second set of polarities for each of the column drivers may correspond to the opposite polarity selected for each of the column drivers in the first set of polarities. According to one line inversion example, each column may be selected to have a positive polarity in the first set of polarities, and each column may be selected to have a negative set of polarities in the second set of polarities. According to one dot inversion example, the first set of polarities may be a positive polarity for each of the odd column drivers, and a negative polarity for each of the even column drivers. The second set of polarities for the dot inversion of example may then be a negative polarity for each of the odd column drivers, and a positive polarity for each of the even column drivers. The second set of polarities for the column drivers is selected such that an associated voltage of each pixel corresponds to approximately zero over time.

The process then proceeds from block 508 to block 510. At block 510, the lines in the second subset are processed. For example, the second subset may include all of the odd lines in the frame.

Figure 5B:
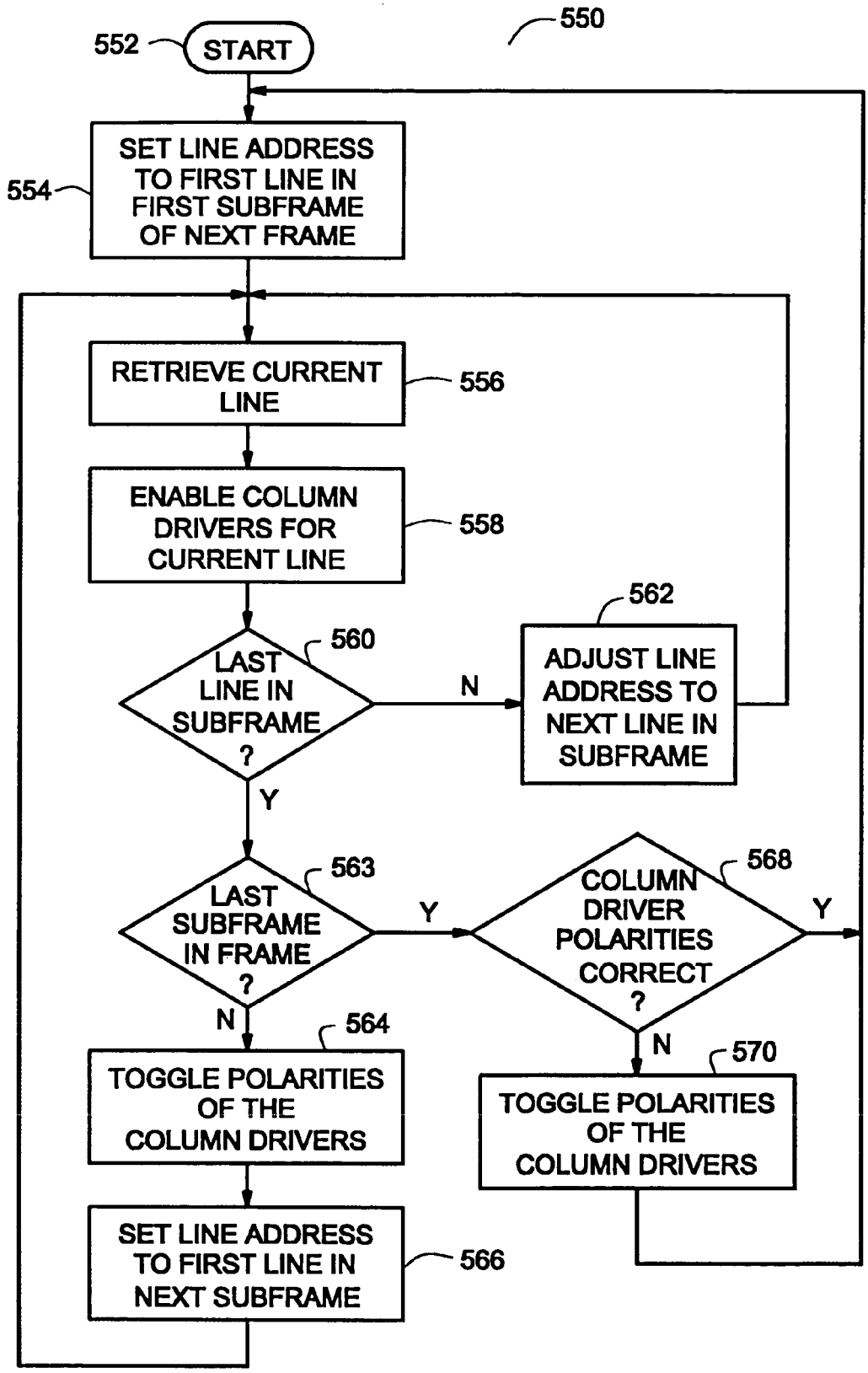
FIG. 5B is a flow chart that illustrates another example process for an LCD.

FIG. 5B illustrates another example process (550) for an LCD, according to aspects of the invention. Processing begins at start block 552.

After start block 552, the process proceeds to block 554. At block 554, a line address is initialized to correspond to a first line in a first subframe of the next frame. Each frame comprises a plurality of subframes. For example, the frame may comprise two subframes, where the first subframe consists of every odd line in the frame, and the second frame consists of every even line in the frame. The process then proceeds from block 554 to block 556. At block 556, the current line is read from the video memory. The process then proceeds from block 556 to block 558. At block 558, the row that corresponds to the current line address is scanned. The process then proceeds from block 558 to decision block 560. At decision block 560, the process determines whether the current line is the last line in the current subframe. The process proceeds from decision block 560 to block 563 when the current line is the last line in the current subframe. Alternatively, the process proceeds from decision block 560 to block 562 when the current line is the not last line in the current subframe. At block 562, the line address is adjusted to correspond to the next line in the current subframe. According to one example, the line address is incremented by two. The next line in the current set refers to the next line in a modified scan sequence order of the lines in the current subframe. The process then proceeds from block 562 to block 556.

At decision block 563, an evaluation is made whether all subframes in the frame have been processed. The process proceeds from decision block 563 to decision block 568 when all subframes in the frame have been processed. Alternatively, the process proceeds from decision block 563 to block 564 when not all of the subframes in the frame have been processed. At block 564, the polarities of the column drivers are toggled. The process then proceeds from block 564 to block 566. At block 566, the line address is adjusted to correspond to a first line of a next subframe of the current frame. For example, the next subframe may consist of every even line in the current frame. The process then proceeds from block 566 to block 556.

At decision block 568, the process evaluates whether the polarities of the column drivers are correct. The polarities of the column drivers are correct when the polarities of the column drivers correspond to polarities that are opposite of the polarities that the column drivers had when a next row to be scanned was previously scanned. The process proceeds from decision block 568 to block 554 when the polarities of the column drivers are correct. Alternatively, the process proceeds from decision block 568 to block 570 when the polarities of the column drivers are not correct. At block 570, the polarities of the column drivers are toggled. Processing then proceeds from block 570 to block 554.

The modified scan sequence order may correspond to a predetermined order. Alternatively, the modified scan sequence order may correspond to a random or pseudo-random order. Selecting a modified scan sequence order that corresponds to a random order may reduce cross-talk artifacts.

Figure 6:
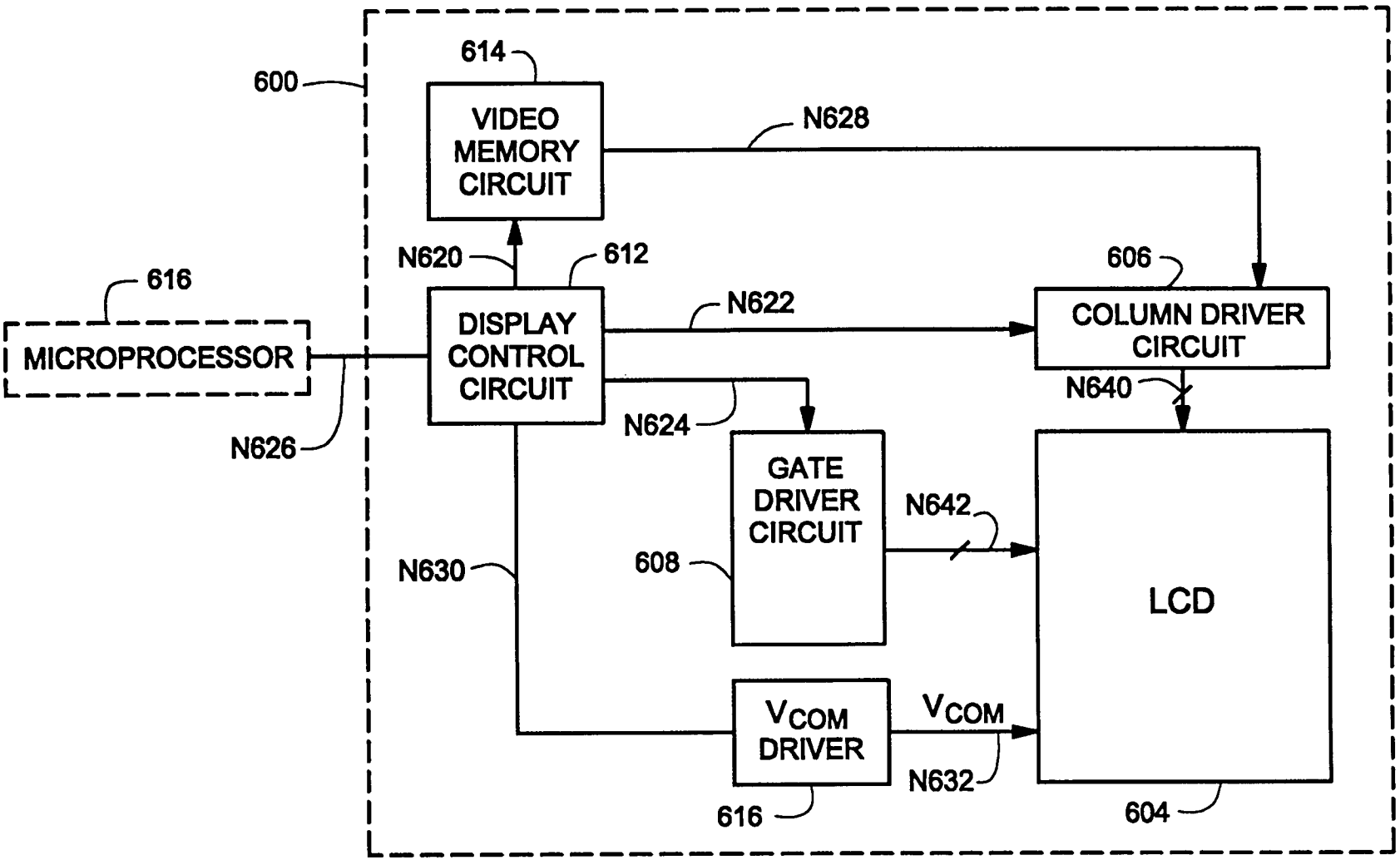
FIG. 6 illustrates an example display system.

FIG. 6 illustrates a display system (600) that is arranged in accordance with aspects of the invention. Display system 600 includes LCD 604, column driver circuit 606, gate driver circuit 608, display control circuit 612, video memory circuit 614, and VCOM driver circuit 616.

Video memory circuit 614 has an input that is coupled to node N620 and an output that is coupled to node N628. Display control circuit 612 has an input that is coupled to node N626, a first output that is coupled to node N620, a second output that is coupled to node N622, a third output that is coupled to node N624, and a fourth output that is coupled to node N630. Column driver circuit 606 has a first input that is coupled to node N622, a second input that is coupled to node N628, and an output that is coupled to node N640. Gate driver circuit 608 has an input that is coupled to node N624 and an output that is coupled to node N642. Vcom driver circuit 616 has an input that is coupled to node N630 and an output that is coupled to node N632. LCD 604 is coupled to node N640, node N642, and node N632.

Column driver circuit 606 is configured to perform D/A conversion and to drive the columns in LCD 604. Column driver circuit 606 is configured to drive electrodes on the glass that run vertically, where each electrode is tied to transistors on that column. Column driver 606 includes a line buffer. According to one example, each of the column drivers drives an associated column of the LCD (604). According to another example, each column driver drives multiple columns.

Vcom driver circuit 616 is configured to provide a common plate voltage to a common plate of LCD 604. Line inversion can be accomplished through Vcom modulation. The common plate voltage is modulated synchronously with the column driver outputs when Vcom modulation is implemented. Alternatively, Vcom driver circuit 616 is configured to provide a stable common plate voltage when Vcom modulation is not implemented.

Gate driver circuit 608 is configured to scan each of the rows in the same modified scan sequence order that the lines are read from video memory circuit 614, as explained in greater detail below.

Video memory circuit 614 is configured to store the display image data. Display control circuit 612 is configured to arbitrate data being written from a microprocessor (616) and data being read for display refresh, and control the refresh sequence for LCD 604. Display control circuit 612 is further configured to receive data for display from microprocessor 616, transfer the data to video memory circuit 614, and control the transfer of data to column driver 606. Display control circuit 612 is further configured to send a signal to column driver circuit 606 that controls the polarity of column driver circuit 606, and affects the drive voltage and the digital/analog conversion characteristics of column driver circuit 606. Display control circuit 612 is further configured to control the transfer of the data from video memory circuit 614 such that lines of data are read from video memory circuit 614 in the modified scan sequence order. Display control circuit 612 is further configured to control the common plate voltage via controlling Vcom driver circuit 616.

According to one example, display system 600 is configured to scan the rows of LCD 604 such that the polarity of the column drivers are reversed once per frame while LCD 604 achieves a display with line version or dot inversion polarity patterns observable at the pixel locations. For a small LCD (604), line inversion may provide acceptable imaging quality, because horizontal cross-talk may not be a significant problem on a small LCD (604). According to one example, gate driver circuit 608 is configured to scan the first row, then the third row, then the fifth row, and so on, until all of the odd rows have been scanned. Then display control circuit 612 reverses the column line polarity. Next, gate driver 608 scans the second row, then the fourth row, then the sixth row, and so on, until all of the even rows have been scanned. According to an alternative example, the lines in each subframe may be processed in a different sequence. According to another alternative example, gate driver 608 may be configured for more than two subframes.

Figure 10:
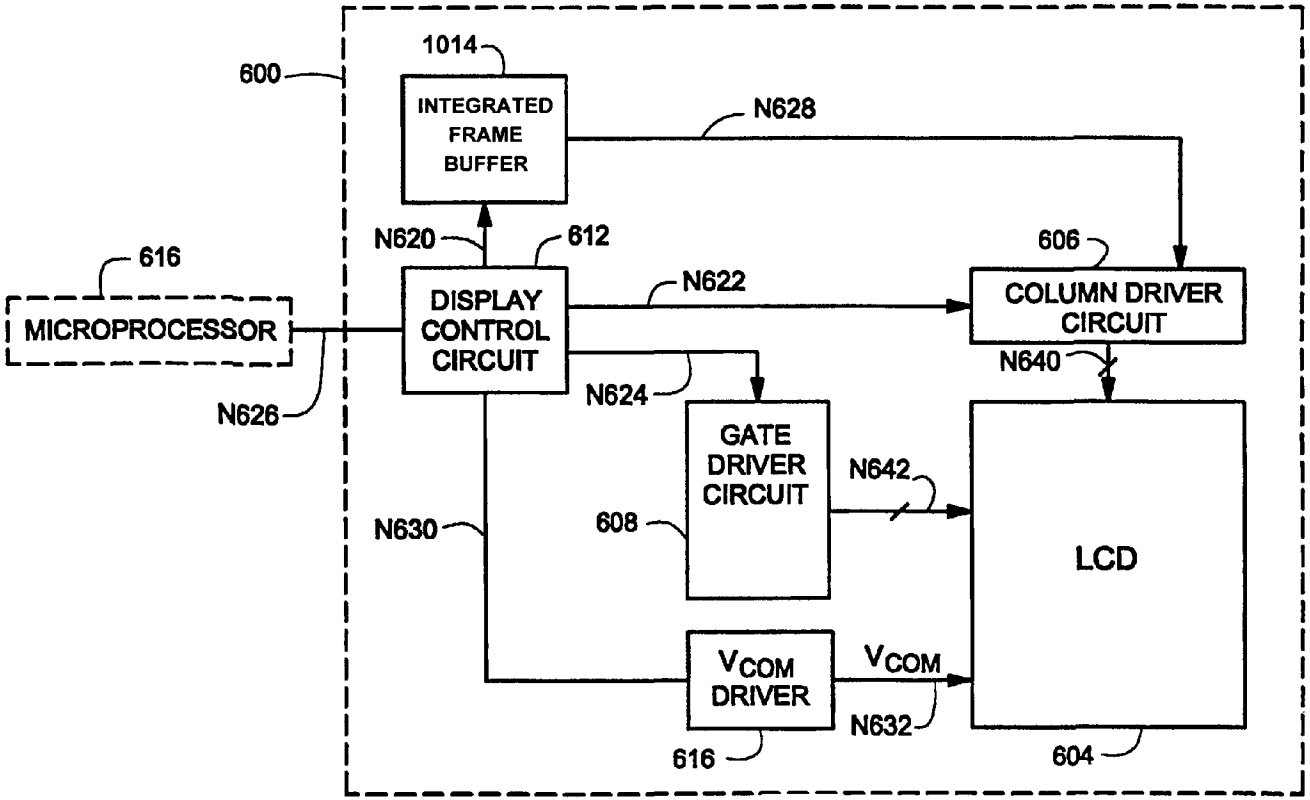
FIG. 10 illustrates an example embodiment of the display system of FIG. 6, according to aspects of the present invention.

Display system 600 is configured to control of the read-out sequence for data stored in the system frame buffer. Display system 600 is also configured to control the scanning pattern of the gate driver to match the read-out sequence of the frame buffer. Conventionally, in large format LCD applications, the graphics controller or host system controls the frame buffer readout. Process 500 is more easily achieved on small LCD applications that include an integrated frame buffer with a column driver circuit that does not have a requirement to provide refresh data to a separate display outside of the system where a standard and predetermined data sequence would be required. For example, FIG. 10 illustrates an embodiment of display system 600 in which the video frame memory 614 is implemented by an integrated frame buffer (1014). For display architectures with an integrated frame buffer, process 500 can be implemented with only minor logic changes to the display refresh circuits. Alternatively, process 500 can be implemented in other applications.

Figure 7:
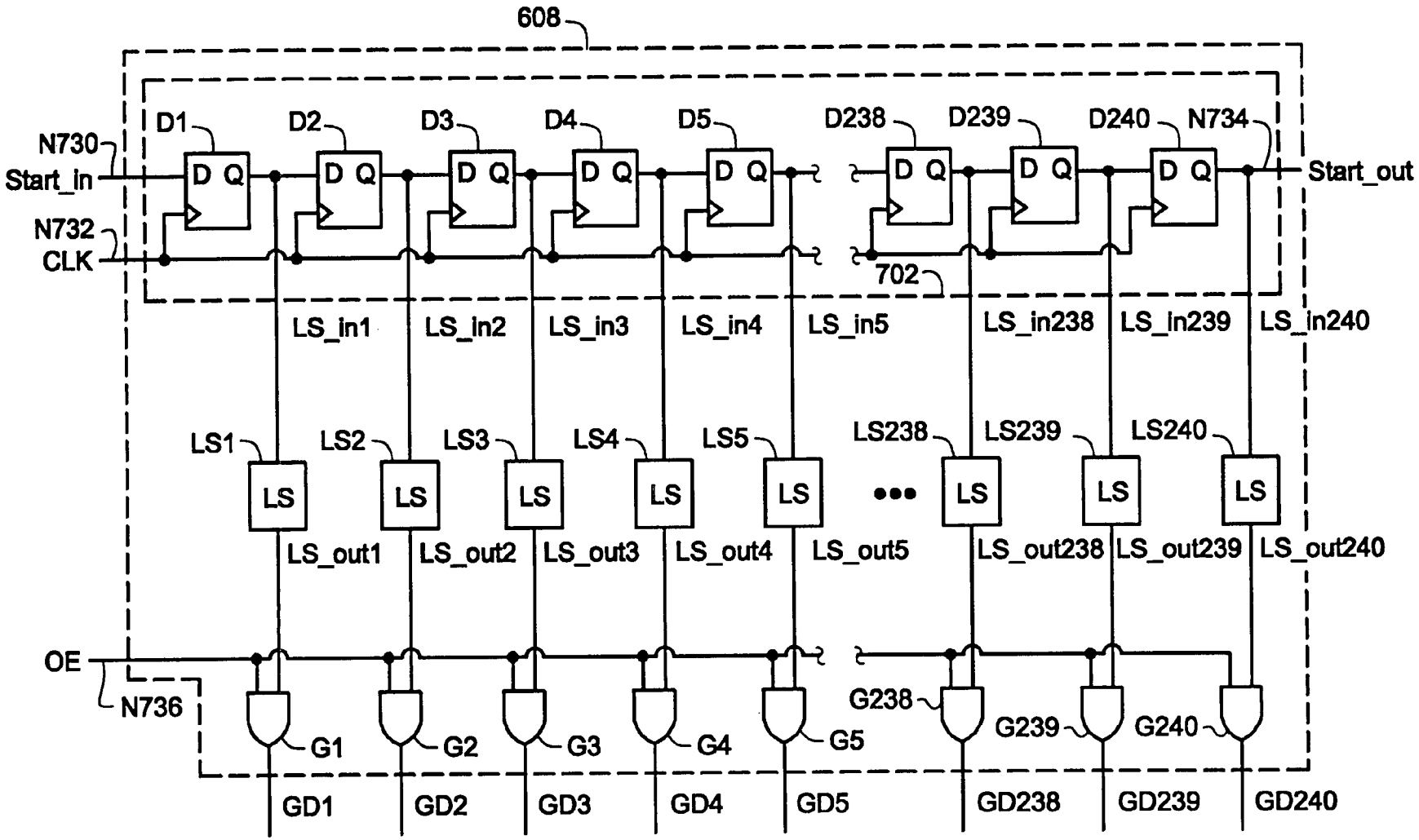
FIG. 7 illustrates a first example of a gate driver.

FIG. 7 illustrates a first example of gate driver circuit 608. Gate driver circuit 608 includes shift register 702, level shifters LS1–LS240, and AND gates G1–G240. Shift register 702 includes D flip-flops D1–D240.

Flip-flop D1 has a D input that is coupled to node N730, and a clock input that is coupled to node N732. Flip-flop D240 has a Q output that is coupled to node N734. The input of level shifter LS240 is coupled to node N734. A first input of each of the AND gates G1–G240 respectively is coupled to node N736. The Q output of each of the flip-flops D1–D239 respectively is coupled the input of each of the level shifters LS1–LS239 respectively. The D input of each of the flip-flops D2–D240 respectively is coupled to the Q output of each of the flip-flops D1–D239 respectively. The output of each of the level shifters LS1–LS240 respectively is coupled to a second input of each of the AND gates G1–G240 respectively. The output of each of the AND gates G1–G240 respectively is coupled to the gate of each transistor in rows 1–240 respectively in LCD 604. Example gate driver circuit 608 is illustrated for an example LCD (604) that contains 240 rows. However, any number of rows may be used.

In operation, signal start_in is applied to node N730, a clock signal (CLK) is applied to node N732, an output enable signal (OE) is applied to node N736, signal start_out is produced at node N734, and each of the rows in LCD 604 are enabled when appropriate, as described in more detail below.

Each of the D flip-flops D1–D240 respectively produce signal LS_in1–LS_in240 respectively. Each of the level shifters LS1–LS240 respectively produce signal LS_out–LS_out240 respectfully in response to signal LS_in1–LS_in240 respectively. The level shifters LS1–LS240 each shift their inputs to the level needed to drives the gates of the transistors of the LCD. Each of the AND gates G1–G240 respectively produces signal GD1–GD240 respectively in response to signal OE and signals LS_out1–LS_out240 respectively. Each AND gate G1–240 respectively is configured to produce signal GD1–GD240 respectively at an active level only when signal OE and signal LS_out1–LS_out240 respectively are both active. Each signal GD1–GD240 respectively enables rows 1–240 respectively when signal GD1–GD240 respectively is active.

Briefly stated, the example of row driver 608 shown in FIG. 7 double-clocks row driver 608 after a first pulse in signal start_in so that only the odd rows are enabled, and so that after a second pulse in signal start_in only the even rows are enabled. The scanning sequence begins when signal start_in transitions to an active level. At the next positive clock transition, signal LS_in1 at the Q output of flip-flop D1 transitions high. Signal OE is inactive, and therefore signal GD1 is inactive. Signal OE is inactive as part of a break-before-make scheme. Subsequently, signal OE transitions to an active level. Since signal OE and signal LS_out1 are both active, signal GD1 transitions to an active level, which causes row 1 to be enabled.

Subsequently, signal OE transitions to an inactive level, causing signal GD1 to transition to an inactive level, which in turn causes row 1 to be disabled. At the next positive clock transition, signal OE is inactive, and remains inactive throughout the clock pulse. Therefore, row 2 is not enabled. At the next positive transition, OE is still inactive at the beginning of the clock pulse. Subsequently, signal OE transitions to an active level, causing signal GD3 to transition to an active level, which causes row 3 to be enabled. Each of the odd rows from 1–240 is sequentially enabled in a similar matter, while the even rows from 1–240 are not enabled, because signal OE is inactive while the even signals from LS_out1–LS out240 are active.

After the odd rows from 1–240 have been enabled, there is a second pulse in signal start_in. At the next positive clock transition, signal LS_in1 transitions to an active level, but signal OE remains inactive throughout the clock pulse, so that row 1 remains disabled. During the next clock pulse, signal LS_in2 is at an active level, and signal OE transition to an active level, so that row 2 is enabled. Each of the even rows from 1–240 is sequentially enabled in a similar manner, while the odd rows from 1–240 are not enabled, because signal OE is inactive while the odd signals from LS_out1–LS_out240 are active.

There are many alternative embodiments of gate driver circuit 608. For example, the order of the AND gates and the level shifters may be reversed.

Figure 8:
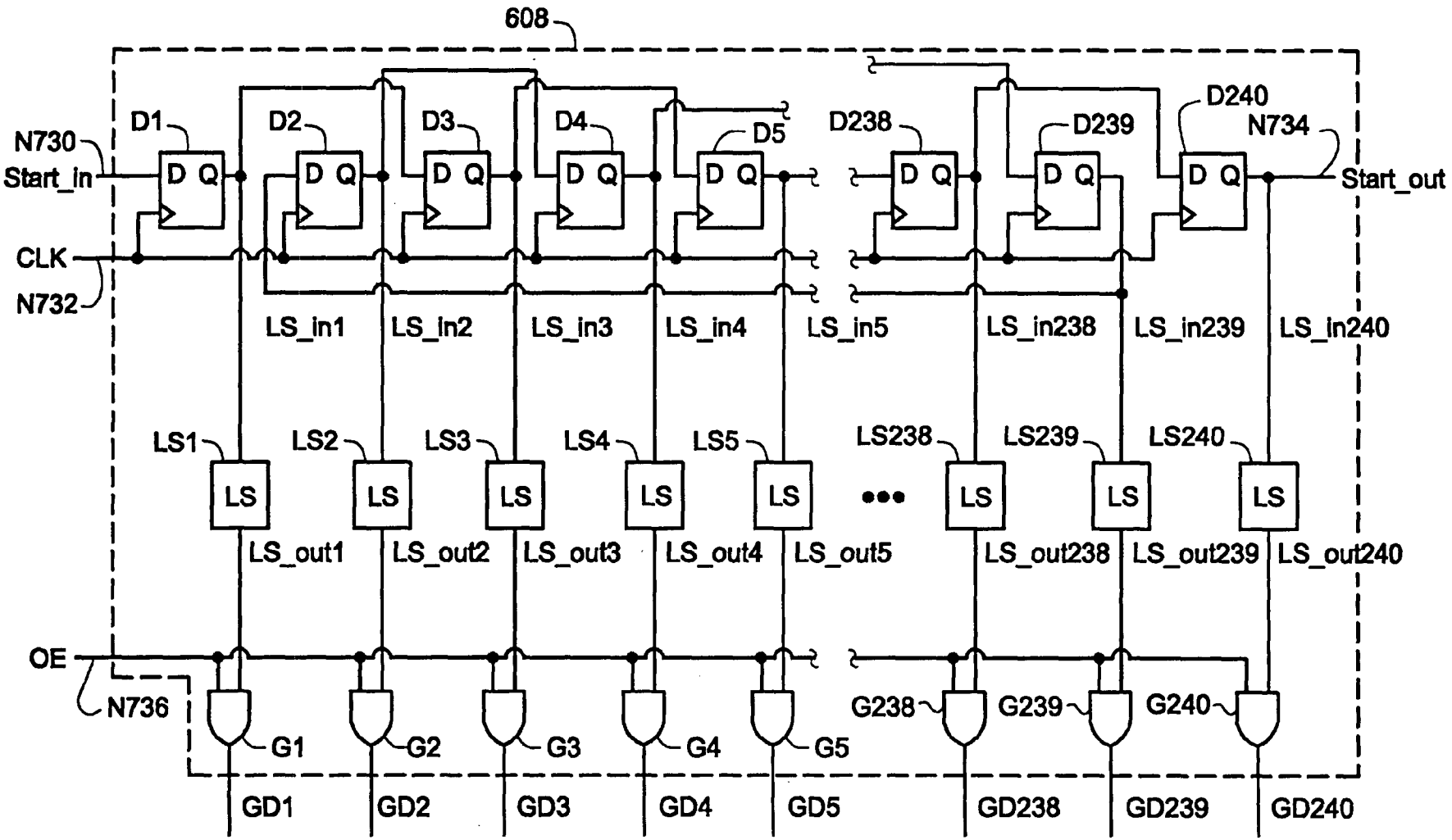
FIG. 8 illustrates a second example of a gate driver.

FIG. 8 illustrates a second example of gate driver circuit 608 that is arranged in accordance with aspects of the invention. Gate driver circuit 608 includes shift register 702, level shifters LS1–LS240, and AND gates G1–G240. Shift register 702 includes D flip-flops D1–D240.

Flip-flop D1 has a D input that is coupled to node N730, and a clock input that is coupled to node N732. Flip-flop D240 has a Q output that is coupled to node N734. The input of level shifter LS240 is coupled to node N734. A first input of each of the AND gates G1–G240 respectively is coupled to node N736. The Q output of each of the flip-flops D1–D239 respectively is coupled the input of each of the level shifters LS1–LS239 respectively. The D input of each of the odd flip-flops-from D3–D239 respectively is coupled to the Q output of each of the odd flip-flops from D1–D237 respectively.

The D input of flip-flop D2 is coupled to the Q output of flip-flop 239. The D input of each of the even flip-flops from 4–240 respectively is coupled to the Q output of each of the even flip-flops from 2–238 respectively. The output of each of the level shifters LS1–LS240 respectively is coupled to a second input of each of the AND gates G1–G240 respectively. The output of each of the AND gates G1–G240 respectively is coupled to the gate of each transistor in rows 1–240 respectively in LCD 604. Example gate driver circuit 608 is illustrated for LCD 604 that contains 240 rows. However, any number of rows may be used.

In operation, signal start_in is applied to node N730, a clock signal (CLK) is applied to node N732, an output enable signal (OE) is applied to node N736, signal start_out is produced at node N734, and each of the rows in LCD 604 are enabled when appropriate, as described in more detail below.

Each of the D flip-flops D1–D240 respectively produce signal LS_in1–LS_in240 respectively. Each of the level shifters LS1–LS240 respectively produce signal LS_out1–LS_out240 respectfully in response to signal LS_in1–LS_in240 respectively. The level shifters LS1–LS240 each shift their inputs to the level needed to drives the gates of the transistors of the LCD. Each of the AND gates G1–G240 respectively produces signal GD1–GD240 respectively in response to signal OE and signals LS_out1–LS_out240 respectively. Each AND gate G1–G240 respectively is configured to produce signal GD1–GD240 respectively at an active level only when signal OE and signal LS_out1–LS_out240 respectively are both active. Each signal GD1–GD240 respectively enables rows 1–240 respectively when signal GD1–GD240 respectively is active.

The scanning sequence begins when signal start_in transitions to an active level. At the next positive clock transition, signal LS_in1 at the Q output of flip-flop D1 transitions high. Signal OE is inactive, and therefore signal GD1 is inactive. Signal OE is inactive as part of a break-before-make scheme. Subsequently, signal OE transitions to an active level. Since signal OE and signal LS_out1 are both active, signal GD1 is active, which causes row 1 to be enabled. Subsequently, signal OE transitions to an inactive level, causing signal GD1 to transition to an inactive level, which in turn causes row 1 to be disabled. The Q output of flip-flop D1 is coupled to the D input of flip-flop D3.

After the next positive clock transition, both signal LS_out3 and signal OE transitions to an active level during the clock pulse, which causes row 3 to be enabled. All of the odd rows from LCD 604 from 1–239 are enabled in a similar manner. The Q output of flip-flop D239 is coupled to the D input of flip-flop D2. After row 239, the next row to be enabled is D2, so that after all of the odd rows from LCD 604 have been sequentially enabled, all of the even rows from 2–240 are enabled in a sequential manner.

Gate driver circuit 608 may be arranged such that each of the gate lines that are associated with the odd rows are arranged on one half of the LCD, and each of the gate lines that are associated with the even rows are arranged on the other half of the LCD.

Figure 9:
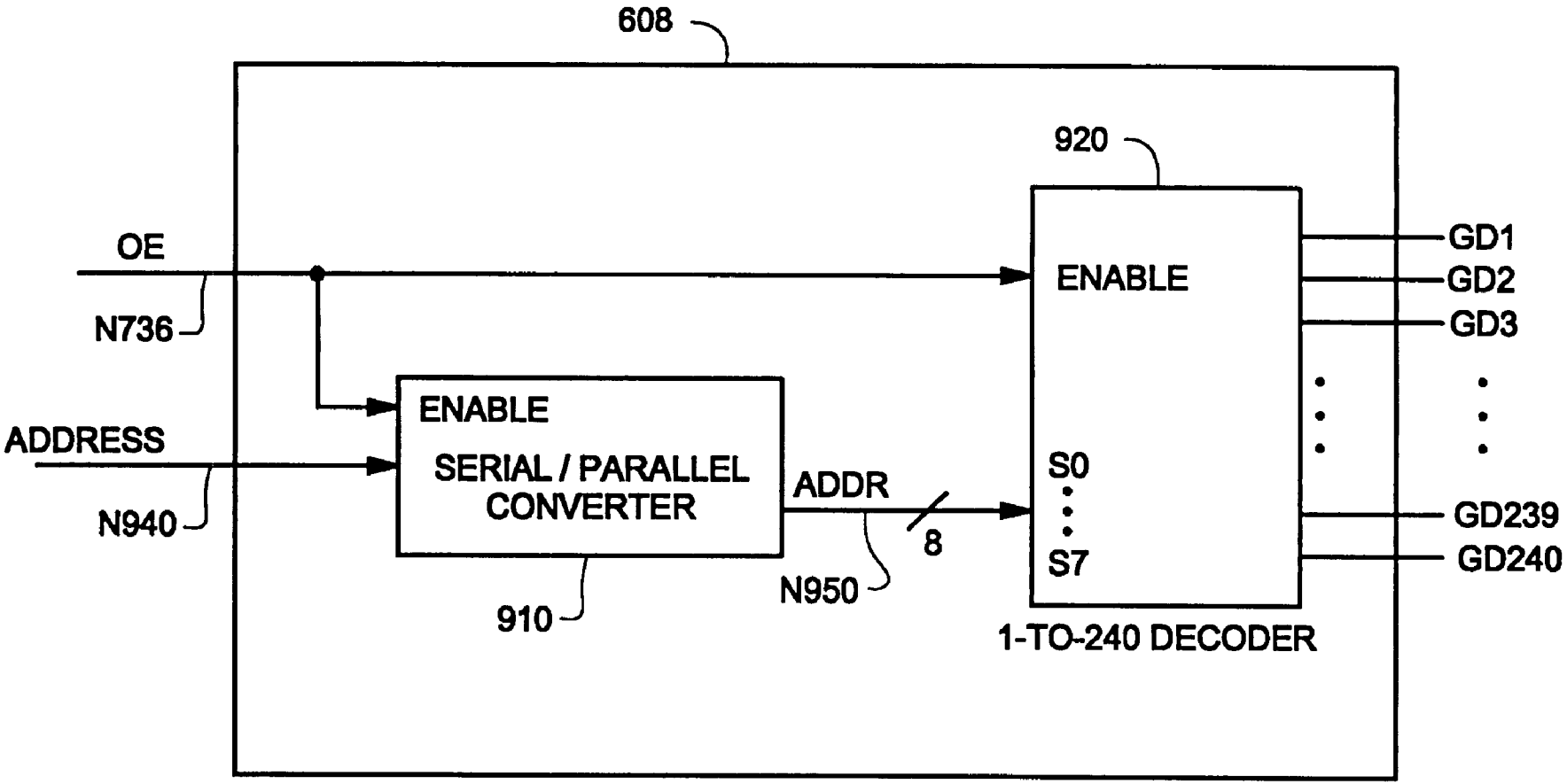
FIG. 9 illustrates a third example of a gate driver.

FIG. 9 illustrates a third example of gate driver circuit 608 that is arranged in accordance with aspects of the present invention. Gate driver circuit 608 includes a serial/parallel converter (910) and a 1-to-240 decoder (920). Serial/parallel converter 910 has a first input that is coupled to node N736, a second input that is coupled to node N940 and an output that is coupled to node N950. 1-to-240 decoder 920 has a first input that is coupled to node N736, and a second input that is coupled to node N950.

In operation, serial/parallel converter 910 is configured to receive a serial address signal (address) from the display control circuit. Signal address corresponds to the current line address. Serial/parallel converter circuit 910 is configured to provide an 8-bit address signal (addr) at node N950 while signal OE is active. 1-to-240 decoder 920 is configured to provide row output signals (GD1–GD240) in response to signal OE and signal addr. 1-to-240 decoder 920 is configured such that each of the row output signals (GD1–GD240) are inactive while signal OE is inactive. 1-to-240 decoder circuit 920 is further configured such that the row output signal that corresponds to the line address associated with signal addr is active when signal OE is active. Signal OE is used as a part of a break-before-make scheme as described above. The example embodiment of gate driver 608 illustrated in FIG. 9 is configured to be capable of scanning the rows in any sequence. For example, the each of the rows associated with the lines of a subframe may be scanned in a random or pseudorandom order.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for an LCD that is organized as rows and columns, wherein data for the LCD is organized according to lines within a frame, the apparatus comprising:

a memory circuit that is configured to store display image data and further configured to couple the display image data to the LCD such that the LCD is capable of processing the display image data, wherein a sequence that the image data is sent to the memory circuit is different from a sequence that the image data is coupled to the LCD; and a display control circuit that is coupled to the memory circuit, wherein the display control circuit is configured to:

receive the display image data, transfer the display image data to the memory circuit, select a first set of line addresses for a first subframe, wherein the first subframe includes at least two lines that are non-adjacent to one another, select a second set of line addresses for a second subframe, select a first scan sequence order for the first subframe of a first frame, select a second scan sequence order for the second subframe of the first frame, select a third scan sequence order for the first subframe of a second frame;

select a fourth scan sequence order for the second subframe of the second frame;

control column driver polarities of a plurality of column drivers such that the column driver polarities correspond to: a first set of polarities during a first time interval while the first subframne of the first frame is processed, a second set of polarities during a second time interval while the second subframe of the first frame is processed, a third set of polarities during the third time interval while the first subframe of the second frame is processed, and a fourth set of polarities during the fourth time interval while the second subframe of the second frame is processed, wherein each pixel in the LCD has an associated drive voltage that corresponds to an average voltage of zero over time, and wherein the second subframe is processed after the first subframe for each frame, control the transfer of the display image data such that the display image data is transferred from the memory circuit to the LCD according to: the first scan sequence order during the first time interval, the second scan sequence order during the second time interval, the third scan sequence order during the third time interval, and the fourth scan sequence order during the fourth time interval; and control a scanning of the rows such that the rows are scanned according to: the first scan sequence order during the first time interval, the second scan sequence order during the second time interval, the third scan sequence order during the third time interval, and the fourth scan sequence order during the fourth time interval.

2. The apparatus as in claim 1, wherein the first and second set of line addresses are selected such tat a display with a line inversion polarity pattern is observable at the pixel locations.

3. The apparatus as in claim 1, wherein the first and second set of line addresses are selected such that a display with a dot inversion polarity pattern is observable at the pixel locations.

4. The apparatus as in claim 1, wherein the first, second, third, and fourth scan sequence orders are selected such that odd rows are scanned first, and even rows are scanned subsequently.

5. The apparatus as in claim 1, further comprising:

a column driver circuit that is coupled to: the memory circuit, the display control circuit, and the LCD, wherein the column driver circuit comprises the plurality of column drivers, and wherein the column driver circuit is configured drive to the columns;

a gate driver circuit that is coupled to the display control circuit and the LCD, wherein the gate driver circuit is configured to scan the rows; and a common plate voltage driver circuit that is coupled to the display control circuit and the LCD, wherein the common plate voltage driver circuit is configured to provide a common plate voltage to the LCD.

6. The apparatus as in claim 5, wherein the display control circuit is further configured to: produce a line address signal that corresponds to a current line address, and control the transfer of the display image data such that a line of display image data is coupled to the column driver circuit, wherein the line of display image data is associated with the current line address; wherein the gate driver circuit comprises an address decoder circuit, and wherein the address decoder circuit is configured to scan a row that corresponds to the current line address in response to the line address signal.

7. The apparatus as in claim 1, wherein the first and second set of line addresses are selected such that a display with a one of a frame inversion polarity pattern and a column inversion polarity pattern is observable at the pixel locations.

8. An apparatus for an LCD that is organized as rows and columns, wherein data for the LCD is organized according to lines within a frame, the apparatus comprising:

a memory circuit that is configured to store display image data and further configured to couple the display image data to the LCD such that the LCD is capable of processing the display image data; and a display control circuit that is coupled to the memory circuit, wherein the display control circuit is configured to:

receive the display image data, transfer the display image data to the memory circuit, select a first set of line addresses for a first subframe, wherein the first subframe includes at least two lines that are non-adjacent to one another, select a second set of line addresses for a second subframe, select a first scan sequence order for the first subframe of a first frame, select a second scan sequence order for the second subframe of the first frame, select a third scan sequence order for the first subframe of a second frame;

select a fourth scan sequence order for the second subframe of the second frame;

control column driver polarities of a plurality of column drivers such that the column driver polarities correspond to: a first set of polarities during a first time interval while the first subframe of the first frame is processed, a second set of polarities during a second time interval while the second subframe of the first frame is processed, a third set of polarities during the third time interval while the first subframe of the second frame is processed, and a fourth set of polarities during the fourth time interval while the second subframe of the second frame is processed, wherein each pixel in the LCD has an associated drive voltage that corresponds to an average voltage of zero over time, and wherein the second subframe is processed after the first subframe for each frame, control the transfer of the display image data such that the display image data is transferred from the memory circuit to the LCD according to: the first scan sequence order during the first time interval, the second scan sequence order during the second time interval, the third scan sequence order during the third time interval, and the fourth scan sequence order during the fourth time interval;

control a scanning of the rows such that the rows are scanned according to: the first scan sequence order during the first time interval, the second scan sequence order during the second time interval, the third scan sequence order during the third time interval, and the fourth scan sequence order during the fourth time interval; and a column driver circuit that is coupled to: the memory circuit, the display control circuit, and the LCD, wherein the column driver circuit comprises the plurality of column drivers, and wherein the column driver circuit is configured drive to the columns;

a gate driver circuit that is coupled to the display control circuit and the LCD, wherein the gate driver circuit is configured to scan the rows; and a common plate voltage driver circuit that is coupled to the display control circuit and the LCD, wherein the common plate voltage driver circuit is configured to provide a common plate voltage to the LCD;

wherein the first, second, third, and fourth scan sequence orders are selected such that odd rows are scanned first, and even rows are scanned subsequently, and wherein the display control circuit is configured to provide an output enable signal and a start signal, wherein the output enable signal is active once every two clock pulses, and wherein the gate driver circuit is responsive to the output enable signal and the start signal such that: each of the odd rows of the LCD are scanned after the gate driver circuit receives a first pulse of the start signal, and each of the even rows of the LCD are scanned after the gate driver circuit receives a second pulse of the start signal.

9. An apparatus for an LCD that is organized as rows and columns, wherein data for the LCD is organized according to lines within a frame, the apparatus comprising:

a memory circuit that is configured to store display image data and further configured to couple the display image data to the LCD such that the LCD is capable of processing the display image data; and a display control circuit that is coupled to the memory circuit, wherein the display control circuit is configured to:

receive the display image data, transfer the display image data to the memory circuit, select a first set of line addresses for a first subframe, wherein the first subframe includes at least two lines that are non-adjacent to one another, select a second set of line addresses for a second subframe, select a first scan sequence order for the first subframe of a first frame, select a second scan sequence order for the second subframe of the first frame, select a third scan sequence order for the first subframe of a second frame;

select a fourth scan sequence order for the second subframe of the second frame;

control column driver polarities of a plurality of column drivers such that the column driver polarities correspond to: a first set of polarities during a first time interval while the first subframe of the first frame is processed, a second set of polarities during a second time interval while the second subframe of the first frame is processed, a third set of polarities during the third time interval while the first subframe of the second frame is processed, and a fourth set of polarities during the fourth time interval while the second subframe of the second frame is processed, wherein each pixel in the LCD has an associated drive voltage that corresponds to an average voltage of zero over time, and wherein the second subframe is processed after the first subframe for each frame, control the transfer of the display image data such that the display image data is transferred from the memory circuit to the LCD according to: the first scan sequence order during the first time interval, the second scan sequence order during the second time interval, the third scan sequence order during the third time interval, and the fourth scan sequence order during the fourth time interval;

control a scanning of the rows such that the rows are scanned according to: the first scan sequence order during the first time interval, the second scan sequence order during the second time interval, the third scan sequence order during the third time interval, and the fourth scan sequence order during the fourth time interval; and a column driver circuit that is coupled to: the memory circuit, the display control circuit, and the LCD, wherein the column driver circuit comprises the plurality of column drivers, and wherein the column driver circuit is configured drive to the columns;

a gate driver circuit that is coupled to the display control circuit and the LCD, wherein the gate driver circuit is configured to scan the rows; and a common plate voltage driver circuit that is coupled to the display control circuit and the LCD, wherein the common plate voltage driver circuit is configured to provide a common plate voltage to the LCD;

wherein the first, second, third, and fourth scan sequence orders are selected such that odd rows are scanned first, and even rows are scanned subsequently, the gate driver circuit comprises a shift register that includes a plurality of flip-flops, wherein each of the plurality of flip-flops is associated with one of the rows of the LCD such that each row of the LCD is scanned when the output of each of the plurality of flip-flops is enabled, and wherein the plurality of flip-flops are arranged such that, for each frame, each of the odd rows are scanned first, and the each of the even rows scanned subsequently.

10. An apparatus for an LCD that is organized as rows and columns, wherein the columns of the LCD are associated with column drivers, and wherein data for the LCD is organized according to lines within a frame, the apparatus comprising:

a display control circuit that is arranged to:

control a video memory circuit to provide graphics data to a column driver circuit such that lines in a first frame of the graphics data are sent to the column driver in an order such that:

the first frame includes a first subframe and a second subframe;

the first subframe includes a first set of lines including at least two non-consecutive lines; and the second subframe includes a second set of lines; and a gate driver circuit that is arranged to scan a line for each row of the LCD for the first frame such that during a first time interval, each line in the first set of lines is scanned in a non-overlapping fashion; and such that in a second time interval that is subsequent to the first time interval, each line in the second set of lines is scanned;

wherein the gate driver circuit includes a plurality of flip-flops; wherein the plurality of flip-flops includes N flip-flops; N is the number of lines in the first frame; each of the N flip-flops includes at least an input and an output; for each of the N flip-flops, the gate driver circuit is arranged to provide N gate enable signals; each the N flip-flops is arranged to provide a separate flip-flop output signal at its output; each of the flip-flops output signals corresponds to a separate gate enable signal; each of the N gate enable signals is based, in part, on the corresponding flip-flop output signal; the output of the first of the N flip-flops is coupled to the output of the third of the N flip-flops, and wherein the output of the second of the N flip-flops is coupled to the output of the fourth of the N flip-flops.

11. An apparatus for an LCD that is organized as rows and columns, wherein the columns of the LCD are associated with column drivers, and wherein data for the LCD is organized according to lines within a frame, the apparatus comprising:

a display control circuit that is arranged to:

control a video memory circuit to provide graphics data to a column driver circuit such that lines in a first frame of the graphics data are sent to the column driver in an order such that:

the first frame includes a first subframe and a second subframe;

the first subframe includes a first set of lines including at least two non-consecutive lines; and the second subframe includes a second set of lines; and a gate driver circuit that is arranged to scan a line for each row of the LCD for the first frame such that, during a first time interval, each line in the first set of lines is scanned in a non-overlapping fashion; and such that in a second time interval that is subsequent to the first time interval, each line in the second set of lines is scanned;

wherein the gate driver control circuit has a plurality of gate driver control signals including a serial address signal and an output enable signal; and wherein the gate driver circuit includes:

a serial/parallel converter that is arranged to provide a multi-bit address signal from the serial address signal; and a 1-to-N decoder, wherein N is the number of lines in the first frame, and wherein the 1-to-N decoder is arranged to provide row enable signal based on the multi-bit address signal and the output enable signal.

12. An apparatus for an LCD, the apparatus comprising:

a display control circuit that is arranged to:

receive graphics data including a first frame that includes a plurality of lines in consecutive sequential order;

provide a polarity control signal to a column driver to control the polarity of the column driver circuit;

provide a plurality of gate driver control signals;

transfer the graphics data to a video memory circuit; and control the video memory circuit to provide the graphics data to the column driver circuit such that the lines in the first frame are re-sequenced; and a gate driver circuit that is arranged to receive the plurality of gate driver control signals, and further arranged to scan the lines of the first frame, based at least in part on the plurality of gate driver control signals such that a scan order of the lines is re-sequenced in accordance with the re-sequencing of the first frame, wherein:

the gate driver circuit includes a plurality of flip-flops; wherein the plurality of flip-flops includes N flip-flops; N is the number of lines in the first frame; each of the N flip-flops includes at least an input and an output; for each of the N flip-flops, the gate driver circuit is arranged to provide N gate enable signals; each the N flip-flops is arranged to provide a separate flip-flop output signal at its output; each of the flip-flops output signals corresponds to a separate gate enable signal; each of the N gate enable signals is based, in part, on the corresponding flip-flop output signal; the output of the first of the N flip-flops is coupled to the output of the third of the N flip-flops, and wherein the output of the second of the N flip-flops is coupled to the output of the fourth of the N flip-flops.

13. An apparatus for an LCD, the apparatus comprising:

a display control circuit that is arranged to:

receive graphics data including a first frame that includes a plurality of lines in consecutive sequential order;

provide a polarity control signal to a column driver to control the polarity of the column driver circuit;

provide a plurality of gate driver control signals;

transfer the graphics data to a video memory circuit; and control the video memory circuit to provide the graphics data to the column driver circuit such that the lines in the first frame are re-sequenced; and a gate driver circuit that is arranged to receive the plurality of gate driver control signals, and further arranged to scan the lines of the first frame, based at least in part on the plurality of gate driver control signals such that a scan order of the lines is re-sequenced in accordance with the re-sequencing of the first frame, wherein:

the plurality of gate driver control signals includes a serial address signal and an output enable signal; and wherein the gate driver circuit includes:

a serial/parallel converter that is arranged to provide a multi-bit address signal from the serial address signal; and a 1-to-N decoder, wherein N is the number of lines in the first frame, and wherein the 1-to-N decoder is arranged to provide row enable signal based on the multi-bit address signal and the output enable signal.

* * * * *

UNITED STATES PATENT AND TRADEMARK OFFICE

CERTIFICATE OF CORRECTION

PATENT NO. : 7,102,610 B2 
APPLICATION NO. : 10/421646
DATED : September 5, 2006
INVENTOR(S) : Christopher A. Ludden It is certified that error appears in the above-identified patent and that said Letters Patent is hereby corrected as shown below:

Column 4, Line 47, Delete "VCOM" and insert -- Vcom --.

Column 6, Line 35-36, Delete "LS_out-L-S_out240" and insert -- LS_out1-LS_out240 --.

Column 7, Line 7, Delete "LS_out-L-S_out240" and insert -- LS_out1-LS_out240 --.

Column 7, Line 35, Delete "flip-flops-from" and insert -- flip-flops from --.

Column 9, Line 29, In Claim 1, delete "subframne" and insert -- subframe --.

Column 9, Line 57, In Claim 2, delete "tat" and insert -- that --.

Column 13, Line 6, In Claim 10, delete "that" and insert -- that, --.

Column 13, Line 8, In Claim 10, delete "that" and insert -- that, --.

Column 13, Line 17, In Claim 10, delete "each the" and insert -- each of the --.

Column 13, Line 13, In Claim 45, In Claim 11, delete "that" and insert -- that, --.

Column 14, Line 21, In Claim 12, delete "each the" and insert -- each of the --.

Signed and Sealed this

Sixteenth Day of January, 2007

JON W. DUDAS
*Director of the United States Patent and Trademark Office*